United States Patent [19]

Morren et al.

[11] 3,953,976

[45] *May 4, 1976

[54] SELF-SUPPORTING WALL

[75] Inventors: George J. Morren, Ottawa County; Neil R. Berndt, St. Joseph, both of Mich.

[73] Assignee: Speidel Foundation & Marine, Inc., Benton Harbor, Mich.

[ * ] Notice: The portion of the term of this patent subsequent to June 28, 1991, has been disclaimed.

[22] Filed: May 20, 1974

[21] Appl. No.: 471,497

Related U.S. Application Data

[63] Continuation of Ser. No. 345,492, March 29, 1973, Pat. No. 3,820,343.

[52] U.S. Cl. ..... 61/4; 61/5

[51] Int. Cl.[2] ..... E02B 3/04

[58] Field of Search ..... 52/71, 581, 609, 608, 52/582, 584, 758 C, DIG. 2; 61/35, 39, 3, 4, 49; 256/19, 26, 27, 28, 24

[56] References Cited

UNITED STATES PATENTS

| | | | |
|---|---|---|---|
| 21,037 | 7/1858 | Van De Mark | 256/27 |
| 217,391 | 7/1874 | Marks | 256/27 |
| 417,205 | 12/1889 | Swift | 256/28 |
| 688,741 | 12/1901 | Knee | 256/27 |
| 2,639,587 | 5/1953 | Hayden | 61/4 |
| 2,871,521 | 2/1959 | Messmore | 52/496 X |
| 2,941,371 | 6/1960 | Benedict | 61/49 |
| 2,960,797 | 11/1960 | Frehner | 61/35 |
| 2,982,290 | 5/1961 | Hunziker | 52/71 |
| 3,016,115 | 1/1962 | Harrison | 52/71 |
| 3,379,015 | 4/1968 | Macks | 61/4 |
| 3,444,694 | 5/1969 | Ferhner | 61/35 |
| 3,614,068 | 10/1971 | Koehl | 256/19 |
| 3,732,653 | 5/1973 | Pickett | 52/71 |
| 3,820,343 | 6/1974 | Morren et al. | 61/35 |

FOREIGN PATENTS OR APPLICATIONS

| | | | |
|---|---|---|---|
| 219,880 | 1/1956 | Australia | 256/26 |
| 1,501,277 | 10/1967 | France | 61/4 |
| 425,124 | 3/1935 | United Kingdom | 61/4 |
| 548,021 | 9/1942 | United Kingdom | 52/582 |

*Primary Examiner*—Dennis L. Taylor

*Attorney, Agent, or Firm*—Woodhams, Blanchard and Flynn

[57] ABSTRACT

A self-supporting wall construction comprising a plurality of V-shaped modules connected together to form a zig-zag shaped wall. Each module comprises a pair of wall segments which extend at an angle relative to one another and have their adjacent ends connected together. The pair of wall segments of each V-shaped module are connected by a substantially horizontal hinge, and the adjacent modules are similarly connected by horizontal hinges whereby the individual wall segments are permitted to vertically pivot relative to one another to conform to an unlevel supporting surface. This hinging movement also enables the individual wall segments to relatively move as required by the external loads imposed thereon.

8 Claims, 6 Drawing Figures

SELF-SUPPORTING WALL

CROSS-REFERENCE TO RELATED APPLICATION

This is a continuation of our copending application Ser. No. 345,492, filed Mar. 29, 1973, now U.S. Pat. No. 3,820,343.

FIELD OF THE INVENTION

This invention relates to a wall construction and, more particularly, to a self-supporting wall construction usable as a sea wall, retaining wall, barrier wall or the like.

BACKGROUND OF THE INVENTION

Many areas of shore line, particularly along the shore line of lakes, such as the Great Lakes, suffer from erosion. The principal cause of erosion is the wave energy of the water and the direction in which sand and other fines of the shore line tend to migrate. Another factor is the composition of the shore line soil itself.

This problem of shore line erosion is particularly severe on the Great Lakes due to the extremely high water level of these lakes, which high water level has existed for several years and apparently will continue to exist for a further substantial period of time. Since much of the shore line around the Great Lakes consists of sand or soil which easily erodes, the high water level has been causing gradual but rather rapid erosion of the shore line and has, in many areas, substantially destroyed the desirable sandy beaches which once existed. Further, the shore line in many areas along the Great Lakes consists of high sand bluffs, and homes and other structures are often built on the top of these bluffs relatively near the edge thereof so as to overlook the lake. The continued existence of the high water level in the Great Lakes, combined with the wave energy of the water, has resulted in the rapid erosion of the base of these sand bluffs. Thus, the bluffs in many areas are being rapidly destroyed, thereby resulting in the destruction of homes and other buildings constructed on the bluffs.

Many different types of piers and retaining walls have been constructed along the shore line in an attempt to prevent erosion of the type described above. However, most of these prior constructions have generally involved the use of structures constructed directly on the site, such as by requiring the sinking of piers or footings into the ground, as by pile driving, or by the constructing of caissons in the ground and by utilizing poured concrete or similarly fabricated steel structures which must be constructed directly at the job site. All of these prior wall constructions have thus been extremely costly due to the requirement that they be constructed directly on the job site. These known structures also often require the use of extremely costly and heavy-duty equipment, particularly since some operations are carried out in the water. Further, since the prior constructions have often required that the wall be anchored to the ground, such as by pilings or other buried footings, this thus makes installation of the wall difficult and costly.

Accordingly, the present invention provides an improved wall structure, particularly suitable for use as a sea wall, which will effectively inhibit shore line erosion and yet overcome the numerous above-mentioned disadvantages associated with known wall constructions. The present wall construction can also be desirably used as an earth retaining wall, a sound barrier, a spatial divider, fence or the like. Accordingly, it is an object to the present invention to provide:

1. A wall construction, as aforesaid, which is of a substantially zig-zag shape and can be positioned directly on a supporting surface in a self-supporting manner, such as directly on a beach when used as a sea wall so as to not require the use of piles or other footings.

2. A wall construction, as aforesaid, which is constructed from a plurality of prefabricated wall segments, which wall segments can be easily connected together into the desired shape directly at the job site.

3. A wall construction, as aforesaid, wherein the adjacent wall sections are connected solely by a substantially horizontal hinge structure which enables adjacent wall sections to pivotally move vertically relative to one another, thus enabling the wall construction to be positioned on a nonlevel supporting surface, with the permissible relative movement between the wall segements also permitting sufficient relative movement within the wall structure to compensate for changes in the supporting surface such as caused by freezing and thawing, while at the same time the wall structure possesses enough relative movement to minimize and equalize the forces imposed thereon, such as due to a collection of ice, to minimize, if not prevent, damage to the wall structure.

4. A wall construction, as aforesaid, wherein the zig-zag shape of the wall substantially breaks and distributes the force of the waves to minimize the force imposed on the wall.

5. A wall construction, as aforesaid, which due to its zig-zag shaped configuration is intended to minimize the general migration of sand along the beach line, which migration for example, occurs from a Northernly to a Southernly direction along Lake Michigan, thus tending to cause the sand to collect within the confines of the wall.

6. A wall construction, as aforesaid, which is of sufficient height to absorb the main force of the wave but which will enable sufficient spillover of the waves to enable some sand to collect in back of the wall to facilitate the build-up of beach behind the wall.

7. The wall construction, as aforesaid, which can be substantially entirely prefabricated so as to require very little job site preparation or job site assembly.

Other objects and purposes of the present invention will be apparent to persons acquainted with the art of this type upon reading the following specification and inspecting the accompanying drawings.

Figure 3:
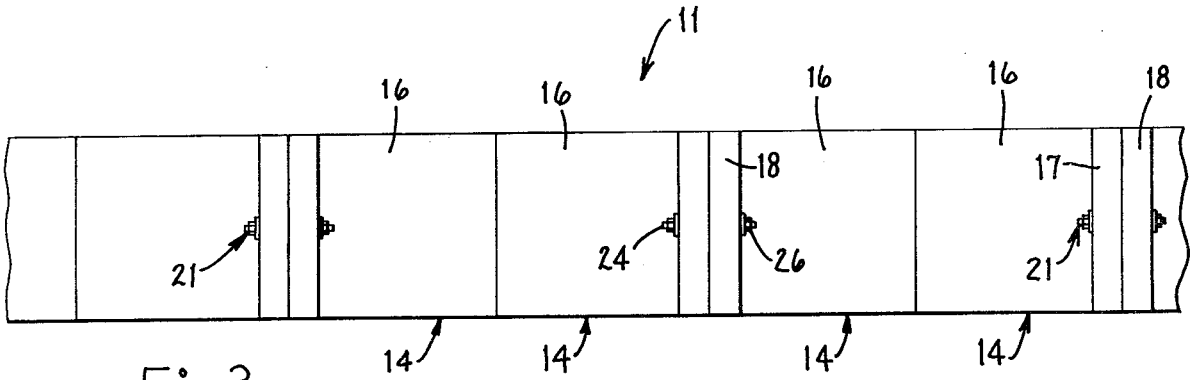
FIG. 3 is an elevational view of the wall construction illustrated in FIG. 2.

Certain terminology will be used in the following description for convenience in reference only. For example, the words "rightwardly" and "leftwardly" will refer to directions in the drawings to which reference is made. The words "upward" and "downward" will refer, respectively, to the upper and lower ends of the wall construction relative to a supporting surface, which upper and lower ends of the wall construction appear as the upper and lower ends in FIGS. 1, 3 and 6. The words "inwardly" and "outwardly" will refer to directions toward and away from, respectively, the geometric center of the wall construction and specific components thereof. Said terminology will include the words above specifically mentioned, derivatives thereof and words of similar import.

SUMMARY OF THE INVENTION

The objects of the present invention, including those mentioned above, are achieved by providing a wall construction which is formed from a plurality of substantially identical slablike wall segments or panels. A plurality of said wall segments are disposed in a substantially zig-zag pattern so that the opposite ends of each wall segment are disposed adjacent and connected to the ends of a pair of further wall segments. The cooperating ends of each pair of wall segments are connected by a single hinge structure which enables adjacent wall segments to relatively move with respect to one another. The hinge structure specifically enables adjacent wall segments to relatively swing about a substantially horizontal axis. The wall construction, when the adjacent wall segments are hingedly connected together in a zig-zag shape, is substantially self-supporting on a suitable supporting surface, such as a beach, even though the supporting surface is not perfectly horizontal or level. The wall segments are preferebly prefabricated, such as by being constructed from steel reinforced concrete. The wall construction can be easily assembled on the job site by positioning the individual wall segments in the desired zig-zag pattern, as by positioning each wall segment directly on the existing beach as in the case of a sea wall construction by means of a crane or derrick, with the adjacent wall segments then having their adjacent edges suitably connected by the above-described hinge structure.

DETAILED DESCRIPTION

Figure 1:
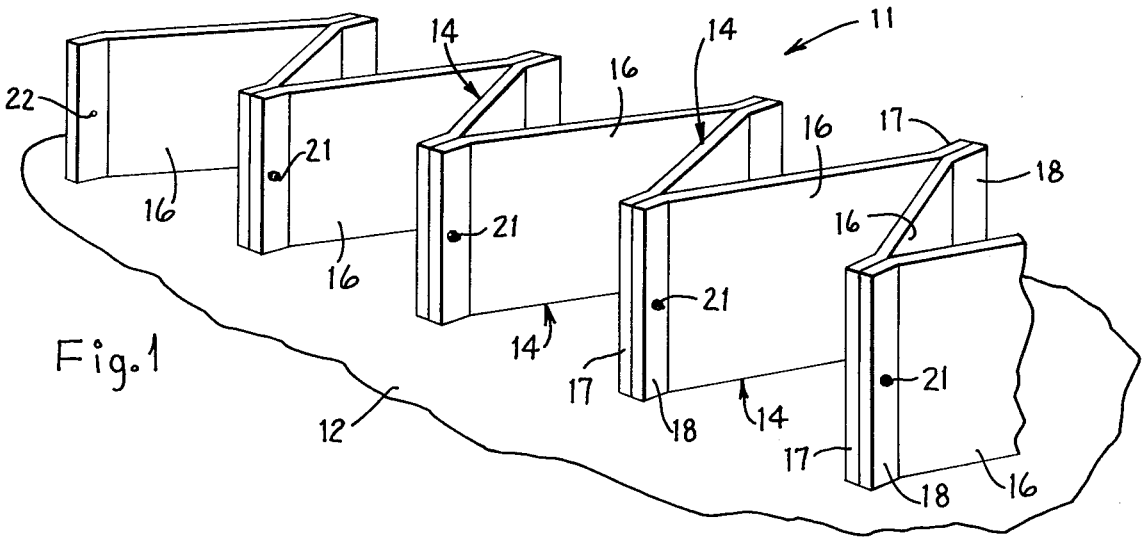
FIG. 1 is a perspective view of a portion of a self-supporting wall construction according to the present invention.

FIG. 1 illustrates a retaining wall 11 constructed according to the present invention, which retaining wall is suitable for use as a sea wall and is adapted to be positioned in a self-supporting manner on a substantially horizontal supporting surface 12, such as the ground. The wall 11 is formed from a plurality of V-shaped modules 13, (FIG. 2) which are connected together so that the wall, when viewed from above, has a substantially zig-zag shape. Each V-shaped module 13 in turn is formed from a pair of substantially identical slablike wall segments or panels 14.

Figure 5:
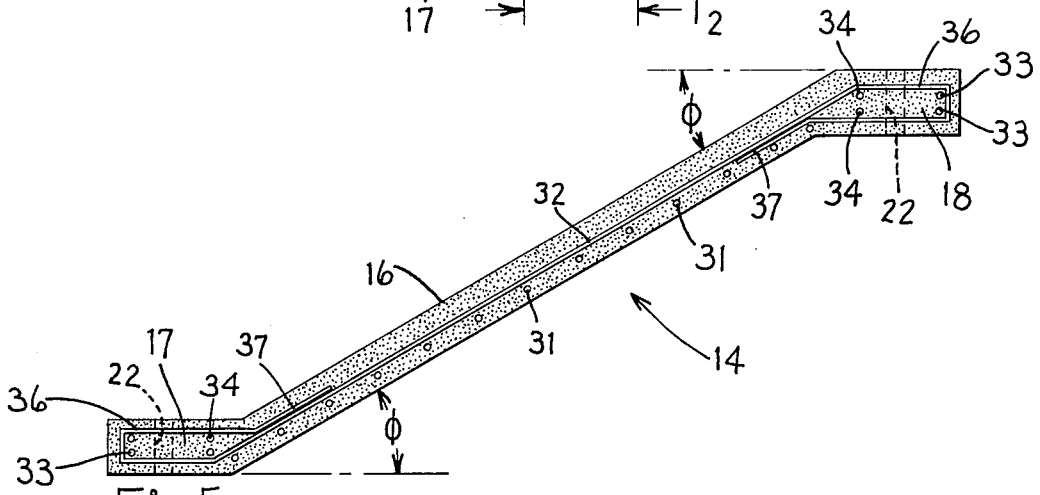
FIG. 5 is a plan view, taken in cross section, and illustrating the internal structure of a wall segment constructed according to the present invention.

Each wall segment 14 includes a substantially rectangular slablike center portion 16 having slablike end portions 17 and 18 fixedly, here integrally, connected to the opposite ends thereof. The end portions 17 and 18 are identical but have been given different reference numerals merely for purposes of identification. Further, the central plane of each end portion 17 and 18 extends at an angle relative to the central plane of the center portion 16, whereupon the opposite end portions 17 and 18 are disposed substantially parallel but laterally spaced from one another. As illustrated in FIG. 5, the center portion 16 is angled relative to the end portions 17 and 18 by an angle $\phi$ which angle $\phi$ is preferably approximately 30° if the wall is used as a sea wall.

Figure 4:
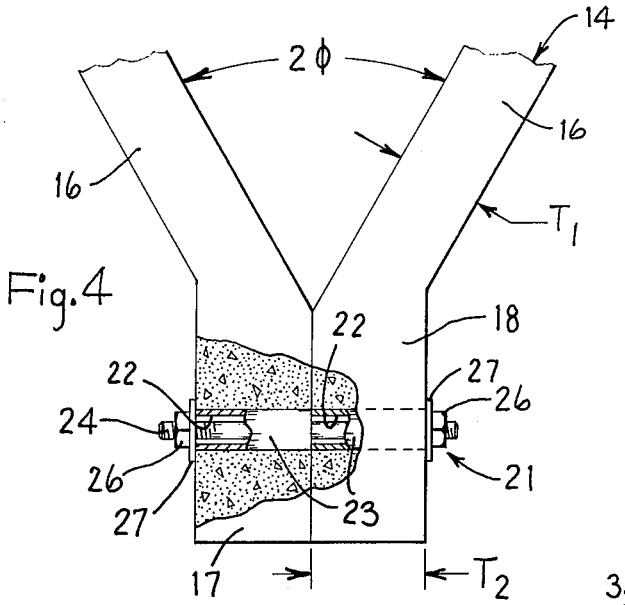
FIG. 4 is an enlarged fragmentary plan view, taken partially in cross section, and illustrating the manner in which the ends of adjacent wall segments are hingedly connected.

The individual wall segments 14 are disposed so that the end portion 17 or 18 of one wall segment is disposed directly adjacent the end portions 17 or 18 of a further wall segment, substantially as illustrated in FIG. 4. When so positioned, wherein the adjacent surfaces are disposed in substantial contact with one another, the center wall portions 16 of the two adjacent wall segments 14 thus define an included angle of 2 $\phi$ therebetween, which angle when the wall is used as a sea wall is approximately 60°.

The adjacent end portions of adjacent wall segements 14 are connected by means of a connecting hinge structure 21, which hinge structure constitutes the sole structure used for interconnecting the adjacent abutting end portions of two adjacent wall segments 14. The hinge structure 21 permits relative pivotal movement between the adjacent wall segments 14 substantially about a horizontal hinge axis as defined by the hinge structure 21. For this purpose, each end portion 17 and 18 of each wall segment 14 is provided with an opening 22 extending substantially transversely therethrough, which opening 22 is disposed substantially midway between the upper and lower edges of the wall segment. The openings 22 associated with the opposite end portions 17 and 18 are each spaced the same distance from the free vertical edge of the respective end portion 17 or 18. Thus, when a pair of wall segments 14 are disposed with their end portions 17 or 18 directly adjacent one another, as illustrated in FIG. 4, the openings 22 in the two adjacent end portions are thus substantially aligned with one another. A suitable liner or sleeve 23 is positioned within each opening 22, as by being cast therein. An elongated connecting element 24, specifically an elongated threaded fastener such as a bolt or threaded stud, extends through the liners 23 with the opposite ends thereof projecting outwardly beyond the opposite external faces of the end portions 17 and 18. A conventional nut 26 is threaded on each end of the fastener 24, the nut 26 being spaced from the face of the end portion 17 or 18 by an intermediate washer 27. Tightening of the nuts 26 toward one another results in the end portions 17 and 18 being snugly held together so that their opposed faces engage and overlie one another. However, bolt 24 still enables the adjacent end portions to pivot relative to one another about the bolt.

Figure 6:
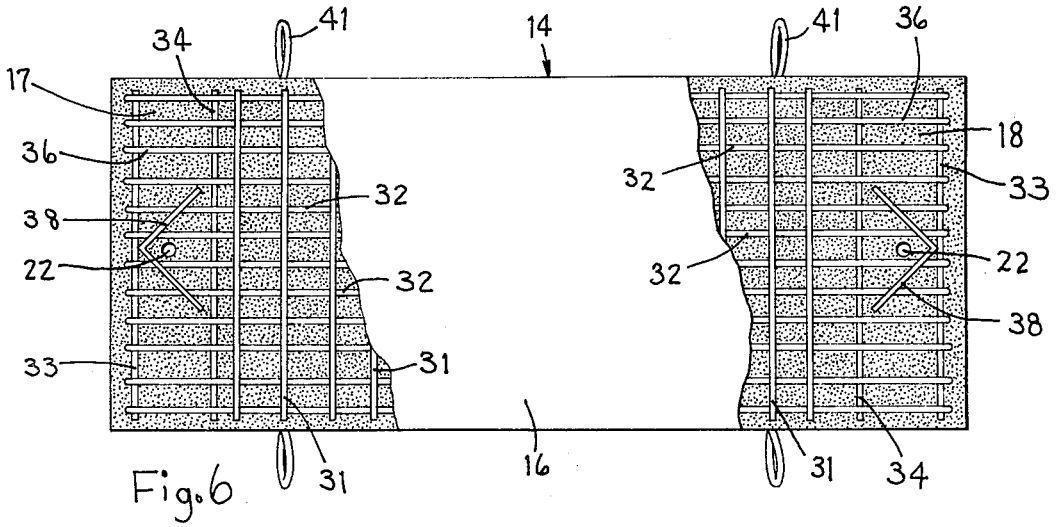
FIG. 6 is an elevational view, taken partially in cross section, of the wall segment illustrated in FIG. 5.

The wall segments 14 are preferably constructed of reinforced concrete as illustrated in FIGS. 5 and 6. The central wall portion 16 includes a plurality of substantially parallel and vertically extending reinforcing rods 31 disposed closely adjacent the central plane of the central wall portion. The vertical reinforcing rods 31 are fixedly connected to a plurality of substantially parallel and horizontally extending reinforcing rods 32, which rods are also disposed closely adjacent the central plane of the central wall portion 16. The rods 31 and 32 thus form a meshlike reinforcing structure. The opposite end portions 17 and 18 of the wall segments 14 are also provided with two pairs 33 and 34 of vertical reinforcing rods disposed therein, which rods are disposed in a substantially rectangular arrangement. The opposite ends of the horizontal rods 32 extend into the end portions 17 and 18 and are formed into closed loops 36, which loops surround the vertical reinforcing rods 33 and 34 as illustrated in FIG. 5. The free end portion 37 of the horizontal rods 32 in turn terminate within the central wall portion 16.

The segment 14 is also provided with an angled reinforcing rod member 38 disposed in the vicinity of each opening 22 (FIG. 6), which angled reinforcing rod 38 extends between and is fixedly connected to a plurality of loop portions 36. The angled reinforcing rod 38 partially surrounds opening 22 and extends between the opening 22 and the adjacent free end of the wall segment so as to reinforce the wall segment in the vicinity of the openings.

The reinforcing rods 31, 32, 33, 34 and 38 are conventional steel reinforcing rods and thus further description of same is not believed necessary.

As illustrated in FIG. 6, each wall segment 14 is preferably provided with opposed pairs of lifting loops 41 thereon, which lifting loops project from the upper and lower surfaces of the wall segment and are disposed adjacent the opposite ends thereof. The lifting loops are constructed from conventional steel cable and are fixedly anchored within the wall segments. The loops 41 enable the individual wall segments to be suitably lifted, as by a derrick or crane, to facilitate their manipulation.

Figure 2:
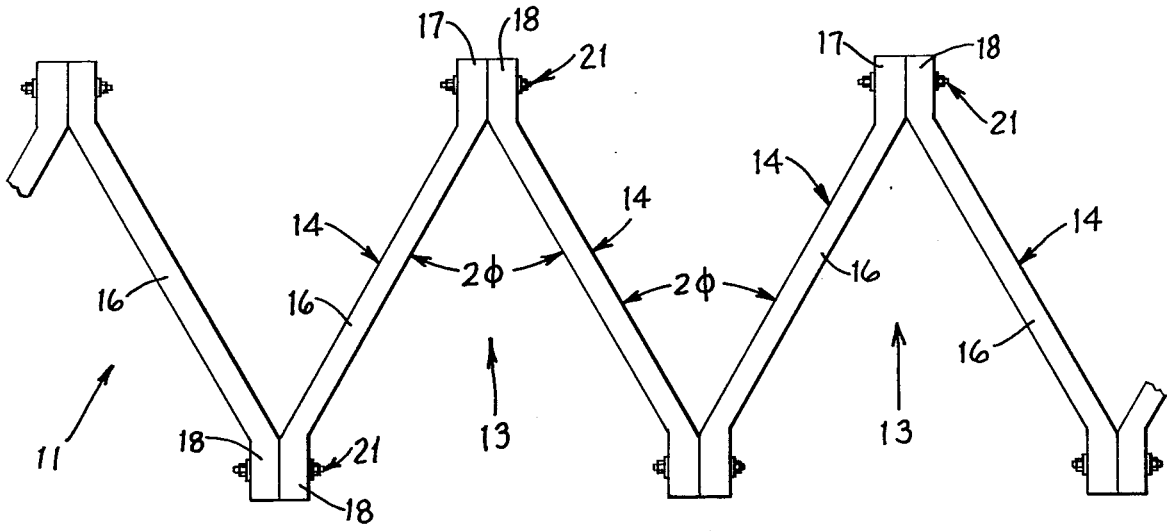
FIG. 2 is a fragmentary plan view of a length of the wall construction of the present invention.

As depicted in FIG. 4, the center portion 16 of wall segment 14 has a thickness $T_1$, whereas the end portions 17 and 18 have a thickness $T_2$, which thickness $T_2$ is substantially greater than the thickness $T_1$. The thickness $T_2$ of the end portions 17 and 18 is approximately 50% greater than the thickness $T_1$ of the center wall portion 16. This thus provides the end portions 17 and 18 with increased strength to enable the adjacent wall segments 14 to be connected by the hinge structure 21, and at the same time enables the end portions, due to the manner in which they project forwardly as illustrated in FIGS. 1 and 2, to withstand the direct forces imposed thereon due to waves or ice if used as a sea wall, or earth pressures if used as a retaining wall.

In a practical embodiment of the present invention, the individual wall segments 14 have a height of approximately 6 feet and an overall length of approximately 16 feet. Of this overall length, each end portion 17 and 18 is approximately 2 feet in length and the center portion 16 is approximately 12 feet in length. Thus, when the adjacent wall segements 14 are connected together in the zig-zag fashion illustrated in FIG. 2, the wall has a depth (as measured perpendicularly from the front to the rear edge thereof) of approximately 15 feet, and the spacing between adjacent aligned end portions is approximately 14 feet. Further, in the illustrated embodiment, the center portions 16 have a thickness $T_1$ of approximately 8 inches and the end portions 17 and 18 have a thickness $T_2$ of approximately 12 inches. The resulting wall segment 14, when provided with these dimensions and constructed of reinforced concrete, thus has a weight of approximately 12,000 pounds. However, the dimensions, weight, etc. of the individual wall segments can be suitable varied according to the design requirements.

OPERATION

When a wall construction 11 according to the present invention is to be positioned on a supporting surface 12, no elaborate preparation of the supporting surface 12 is necessary since the wall construction 11 will readily accommodate and conform to the surface 12, even though the surface 12 is unlevel or deviates slightly from the horizontal. The wall construction 11 is disposed and assembled on the surface 12 by positioning the prefabricated wall segments 14 directly adjacent one another in a zig-zag fashion, as illustrated in FIG. 2, so that the opposite end portions of each wall segment 14 are disposed directly adjacent the end portions of two adjacent wall segments. More specifically, two wall segments 14 are positioned in a self-supporting manner directly on the surface 12, as by a crane or derrick, the two segments being disposed so that their adjacent end portions have their opposed faces substantially flush with one another, as illustrated in FIG. 4. If necessary, one of the wall segments can be lifted as required so that the openings of the sleeves 23 are substantially aligned, whereupon bolt 24 is inserted through the sleeves 23 and the nuts 26 are tightened on the opposite ends thereof. In this manner, the adjacent coacting end portions of adjacent wall segments 14 are thus structurally connected together. This manner of connecting the adjacent wall segments 14 is continued throughout the length of the wall 11, thereby resulting in a zig-zag shaped wall substantially as illustrated in FIGS. 1 and 2.

The hinge structure 21, as defined by the sleeves 23 and bolt 24, permits the adjacent wall segments 14 to vertically move relative to one another substantially about a horizontal hinge axis as defined by the bolt 24. This structure 21 thus permits the two adjacent pivotally connected wall segments 14 to vertically swing relative to one another so that the lower surfaces thereof adapt to and conform with the supporting surface 12, even though this surface 12 is somewhat uneven or nonplanar. Thus, the complete wall 11 can be easily and readily installed directly on an existing support surface 12, such as a beach, merely by hoisting the prefabricated wall segments 14 into the desired position and then connecting same by the hinge structure 21. The hoisting of the segments 14 into position can be performed by either a crane or derrick. Further, since the panels 14 have an overall length which is substantially greater than their height, the resulting assembled wall 11 rests freely on the surface 12 in a stable condition without requiring any anchoring of same by means of footings, piers or the like when used as a seawall.

Since the overall width of the assembled wall 11, that is, the perpendicular distance measured from the front to the rear edge thereof as illustrated in FIG. 2, is of a rather large magnitude, and since the wall is of substantial weight, this thus enables the wall to absorb rather large forces which are imposed thereon, such as by waves or earth pressures, without fear of the wall being tipped over. Still further, since the wall height, when used as a sea wall, is substantially less than the width of the wall, such as in the order of 40 to 50% thereof, the force imposed on the wall by the waves will be imposed on the wall at a rather low elevation to thus minimize the tipping moment imposed on the wall. Also, the portion of the waves which are disposed at a high elevation, which portion is of rather low force, will readily spill over the top of the wall so as to enable sand suspended within the water to collect on the rear side of the wall.

When the wall 11 is installed as a sea wall, same is preferably positioned on the support surface or beach 12 so that it extends along the beach. Thus, when the waves strike the wall 11, they initially strike the projecting forward ends of the wall segments as defined by the coupled end portions 17 and 18 as illustrated in FIG. 1. However, the portions of the waves located between the coupled end portions 17 and 18 enter into the triangular spaces defined between the center wall portions 16 and thus strike the wall at a subsequent time. The zig-zag shape of the wall thus effectively breaks the waves and distributes the force of the waves as imposed on the wall over a substantial period of time, thus minimizing the impact force which is imposed on the wall at any instant of time. Further, since the waves normally cause the sand to migrate in one direction along the beach, the zig-zag shape of the wall tends to minimize this migration of the sand and causes some of the sand to collect in front of the wall within the triangular spaces defined between the adjacent diverging wall segments.

The wall structure 11 as illustrated in FIG. 1 is also highly desirable for withstanding ice, such as occurs along the shore line of the Great Lakes. The zig-zag shape of the wall 11 makes the wall extremely durable and able to withstand the impact of ice thereon, particularly since the adjoined forward end portions of the wall segments effectively penetrate the ice and tend to break up the ice. At the same time, these end portions of the wall segments are provided with increased thickness and increased metal reinforcing therein so as to withstand the impact thereon by the ice. Further, since the ice imposes very nonuniform forces on the wall, this nonuniform force can be partially absorbed without causing damage or breakage of the wall due to the permissible relative movement between the adjacent wall segments as permitted by the hinge structures 21.

Since all of the wall segments 14 are substantially identical, this greatly simplifies the positioning of the wall segments during initial installation on a support surface, such as a beach, since the wall segments can be easily interchanged, end for end, without disrupting the manner in which the end sections of adjacent walls are interconnected by the hinge structures 21.

While the wall structure of the present invention preferably utilizes steel reinforced concrete for the prefabricated wall segments 14, the wall segments can be constructed and prefabricated in some other manner, such as by being prefabricated from steel or the like.

The wall structure of the present invention can also be used as a groin or jetty positioned to extend outwardly into the water at a substantial angle to the beach, such as perpendicular thereto. The outwardly extending jetty can be coupled with a further length of wall (as illustrated in FIG. 1) which extends substantially along the beach.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privelege is claimed are defined as follows:

1. In a self-supporting sea wall construction adapted to be positioned on a support surface, such as the ground, the improvement comprising:

a plurality of prefabricated upright wall segments connected in series with one another and defining a zig-zag shape, the individual wall segments being of a rigid and unitary structure, said wall segments also being relatively heavy so that the wall construction can withstand imposition of substantial forces on the sides thereof; and pivot means connecting the adjacent upright wall segments together for enabling continuous relative pivotal movement between said adjacent wall segments about a pivot axis which extends in a direction substantially parallel to the longitudinally extending direction of said wall, said pivot means permitting the individual wall segments to substantially conform to the supporting surface.

2. A sea wall construction according to claim 1, wherein said pivot means includes a hinge pin extending between and connecting the adjacent end portions of said adjacent wall segments, said hinge pin including threaded fastener means associated therewith for connecting the adjacent end portions of said adjacent wall segments together.

3. A sea wall construction according to claim 1, wherein the adjacent wall segments define an included angle therebetween which is a maximum of approximately 60°.

4. A sea wall construction according to claim 1, wherein each of said wall segments includes an elongated center wall portion and a pair of end portions fixedly connected to the opposite ends of the center wall portion, said end portions being substantially parallel to one another and each extending at an acute angle relative to the central plane defined by said center wall portion.

5. A sea wall construction according to claim 4, wherein each said end portion extends at an angle of approximately 30° relative to the central plane of the center wall portion, and wherein the center wall portions of adjacent wall segments define an angle of approximately 60° therebetween.

6. A sea wall construction according to claim 5, wherein said end portions have a thickness substantially greater than the thickness of said center wall portion and a length substantially less than the length of said center wall portion.

7. Improvements in a sea wall construction adapted to be positioned on the ground, such as a beach or the bottom of a body of water, comprising:

a plurality of upright wall segments connected horizontally in series with one another, the adjacent wall segments being disposed at an angle of approximately 60° relative to one another so that said plurality of wall segments as disposed in series defines a zig-zag shaped sea wall which is self-supporting and which sits on the ground in an upright freestanding manner, said sea wall being free of pilings or buried footings;

each of said wall segments comprising a single, one-piece, prefabricated, heavy slablike panel which is substantially free of openings therethrough;

each of said wall segments including an elongated slablike center portion and a pair of relatively short slablike end portions fixedly connected to opposite ends of said center portion, said end portions being substantially parallel but laterally offset from one another and each extending at an angle of approximately 30° relative to the central plane of said center portion; and fastening means extending between and connecting the adjacent end portions of adjacent panels for connecting said panels in said zig-zag shape, the adjacent panels when connected together defining an included angle therebetween of approximately 60°.

8. A sea wall construction according to claim 7, wherein said fastening means enables the adjacent panels to vertically move relative to one another through at least a limited distance so as to conform to the ground.

* * * * *